US009074764B2

(12) United States Patent
Hull et al.

(10) Patent No.: US 9,074,764 B2
(45) Date of Patent: Jul. 7, 2015

(54) BURNER HAVING A PILOT BURNER SYSTEM WITH SWIRLER WINGS AND A PLURALITY OF OUTLET NOZZLES

(75) Inventors: Karl Henrik Gunnar Hull, Norrköping (SE); Håkan Brodin, Linköping (SE); Xiufang Gao, Svärtinge (SE); Magnus Persson, Svärtinge (SE); Zeljko Vujicic, Finspang (SE); Patric Österlund, Svärtinge (SE)

(73) Assignee: SIEMENS AKTIENGESELLSCHAFT, München (DE)

( * ) Notice: Subject to any disclaimer, the term of this patent is extended or adjusted under 35 U.S.C. 154(b) by 1175 days.

(21) Appl. No.: 12/937,770

(22) PCT Filed: Apr. 14, 2009

(86) PCT No.: PCT/EP2009/054365

§ 371 (c)(1),
(2), (4) Date: Aug. 3, 2011

(87) PCT Pub. No.: WO2009/127606

PCT Pub. Date: Oct. 22, 2009

(65) Prior Publication Data

US 2012/0036855 A1 Feb. 16, 2012

(30) Foreign Application Priority Data

Apr. 15, 2008 (EP) ..... 08007392

(51) Int. Cl.

| | |
|---|---|
| ***F23R 3/34*** | (2006.01) |
| ***F23D 14/02*** | (2006.01) |
| ***F23D 14/82*** | (2006.01) |

(Continued)

(52) U.S. Cl.

CPC ..... *F23D 14/02* (2013.01); *F23D 11/103* (2013.01); *F23D 14/82* (2013.01); *F23D 2209/10* (2013.01); *F23D 2900/14003* (2013.01); *F23D 2900/14021* (2013.01);

(Continued)

(58) Field of Classification Search

CPC ..... F23D 11/10; F23D 14/08; F23D 14/82; F23D 2900/14701; F23D 2900/14021; F23D 2900/14003; F23R 3/34; F23R 3/28; F23R 3/286; F23R 3/346

USPC ..... 60/737, 739, 747, 748

See application file for complete search history.

(56) References Cited

U.S. PATENT DOCUMENTS 5,361,586 A * 11/1994 McWhirter et al. ..... 60/737
5,836,164 A * 11/1998 Tsukahara et al. ..... 60/733

(Continued)

FOREIGN PATENT DOCUMENTS

CN 1680706 A 10/2005
EP 0101109 A2 2/1984

(Continued)

*Primary Examiner* — William H Rodriguez
*Assistant Examiner* — Carlos A Rivera

(57) ABSTRACT

A burner with a burner head is provided. The burner includes a mixing tube for premixing combustion air and fuel. The mixing tube is provided with a pilot burner system in its downstream part. The pilot burner system includes an annular mixing cavity with an entrance for assist air and pilot fuel and outlet nozzles. The mixing cavity is provided with at least two swirler wings arranged in the vicinity of each outlet nozzle.

18 Claims, 3 Drawing Sheets

(51) Int. Cl.
*F23D 11/10* (2006.01)
*F23R 3/28* (2006.01)

(52) U.S. Cl.
CPC ..... *F23D 2900/14701* (2013.01); *F23R 3/286* (2013.01); *F23R 3/343* (2013.01)

(56) References Cited

U.S. PATENT DOCUMENTS

| | | | | |
|---|---|---|---|---|
| 5,954,495 | A * | 9/1999 | Knopfel et al. | 431/285 |
| 6,036,475 | A | 3/2000 | Matsui et al. | |
| 6,179,608 | B1 | 1/2001 | Kraemer et al. | |
| 6,210,152 | B1 * | 4/2001 | Haffner et al. | 431/12 |
| 6,363,724 | B1 * | 4/2002 | Bechtel et al. | 60/737 |
| 6,453,673 | B1 * | 9/2002 | Bechtel et al. | 60/776 |
| 6,460,326 | B2 * | 10/2002 | Bechtel et al. | 60/39.465 |
| 7,140,183 | B2 * | 11/2006 | Ruck et al. | 60/737 |
| 7,972,133 | B2 * | 7/2011 | Bernero et al. | 431/278 |
| 8,528,334 | B2 * | 9/2013 | Dutta et al. | 60/723 |

FOREIGN PATENT DOCUMENTS

| | | | |
|---|---|---|---|
| EP | 1389713 | A1 | 2/2004 |
| SU | 1090969 | A1 | 5/1984 |
| SU | 1315729 | A1 | 6/1987 |
| SU | 1476251 | A1 | 4/1989 |
| SU | 1763835 | A1 | 9/1992 |
| SU | 1789295 | A1 | 1/1993 |
| WO | WO 0025065 | A1 | 5/2000 |
| WO | WO 2007110298 | A1 * | 10/2007 |

* cited by examiner

BURNER HAVING A PILOT BURNER SYSTEM WITH SWIRLER WINGS AND A PLURALITY OF OUTLET NOZZLES

CROSS REFERENCE TO RELATED APPLICATIONS

This application is the US National Stage of International Application No. PCT/EP2009/054365, filed Apr. 14, 2009 and claims the benefit thereof. The International Application claims the benefits of European Patent Office application No. 08007392.7 EP filed Apr. 15, 2008. All of the applications are incorporated by reference herein in their entirety.

FIELD OF INVENTION

The present invention relates to a burner with a burner head according to the features of the claims.

BACKGROUND OF INVENTION

Such burners are preferably adapted for firing the combustion chamber of a gas turbine. A burner known from EP 1 389 714 A1 comprises a swirl generator and a downstream mixing tube. The burner head is provided with a pilot burner system to support the main flame. The pilot burner system comprises a mixing cavity for mixing pilot fuel and assist air. The mixing cavity of the known burner is of a pure circumferential shape. Within such a designed mixing cavity there is a risk for the pilot flame to burn inside.

SUMMARY OF INVENTION

The object of the present invention is to improve a burner head of the above type in such away that a risk of a flash back, i.e. upstream propagation of the flame, is minimized.

The object is accomplished in a burner according to the claims by the characterizing features of this claim. Advantageous embodiments of the invention are described in the subclaims.

The swirl wings inside the mixing cavity of the inventive burner head induce a swirl to the incoming assist air flow. The air flow afflicted with the swirl forces the fuel to stay inside the outlet nozzles and not to "leak out" into the mixing cavity.

Document EP 1 389 714 A can be considered to be closest prior art to the object of claim 1 and deals with a burner according to the preamble of claim 1. Document U.S. Pat. No. 6,179,608 B1 deals with a flashback arrestor, which combines a conventional flashback arrestor and a swirler.

U.S. Pat. No. 6,179,608 B1 shows a swirling flashback arrestor, which is provided with directed nozzles at the exit of separated channels to generate a in order to avoid the flashback of a flame by means of several directed nozzles. This arrangement is suitable to be provided after a completed mixing process in a combustor main flow since the channeling disables further mixing. According to the invention the pilot mixture flow proceeds through the outlet nozzle after being swirled, establishing a swirl coaxially to the nozzle which improves mixing and avoids flashbacks effectively. EP 1 389 713 A1 discloses a pilot burner, without effective flashback prevention.

BRIEF DESCRIPTION OF THE DRAWINGS

The invention will now be elucidated by reference to the embodiment of the invention illustrated in the drawings.

DETAILED DESCRIPTION OF INVENTION

Figure 1:
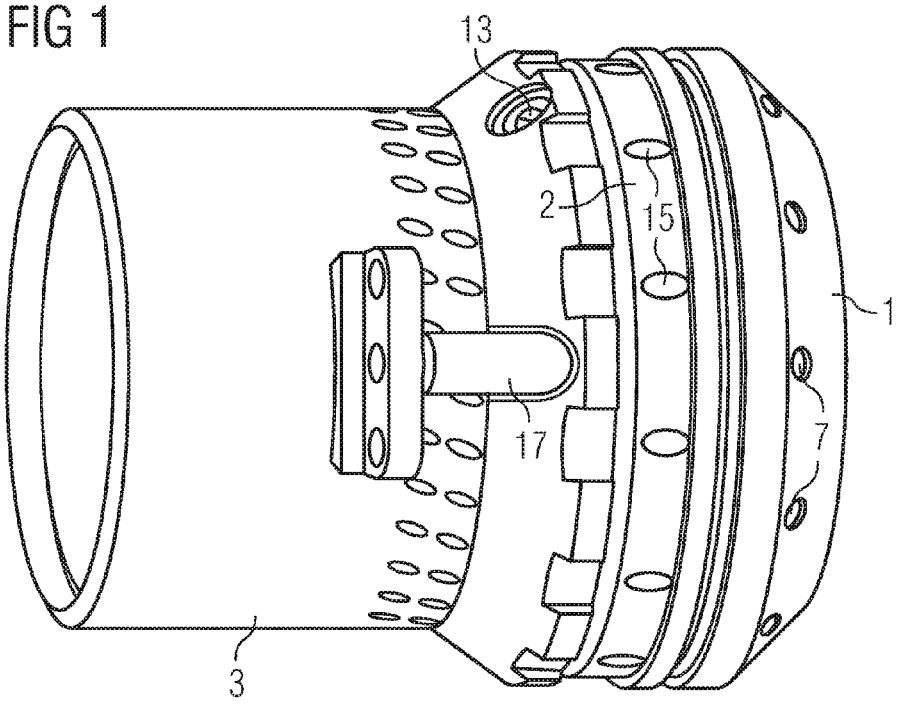
FIG. 1 shows in perspective view a burner head.

The present burner comprises a cylindrical burner head and an upstream swirl generator. A number of such burners are used for burning a fuel/air mixture in a combustion chamber of a gas turbine. In the drawing the burner head is shown only, because the invention relates to an improvement of the burner head, and the swirl generator is well known in the prior art, e.g. from EP 1 389 713 A1.

The not shown swirl generator is swirling an air stream which enters the swirl generator via slots. A fuel is introduced into the air stream. The premixed swirling mixture of air and fuel enters the mixing tube for further mixing before leaving the discharge end of the burner head.

Figure 2:
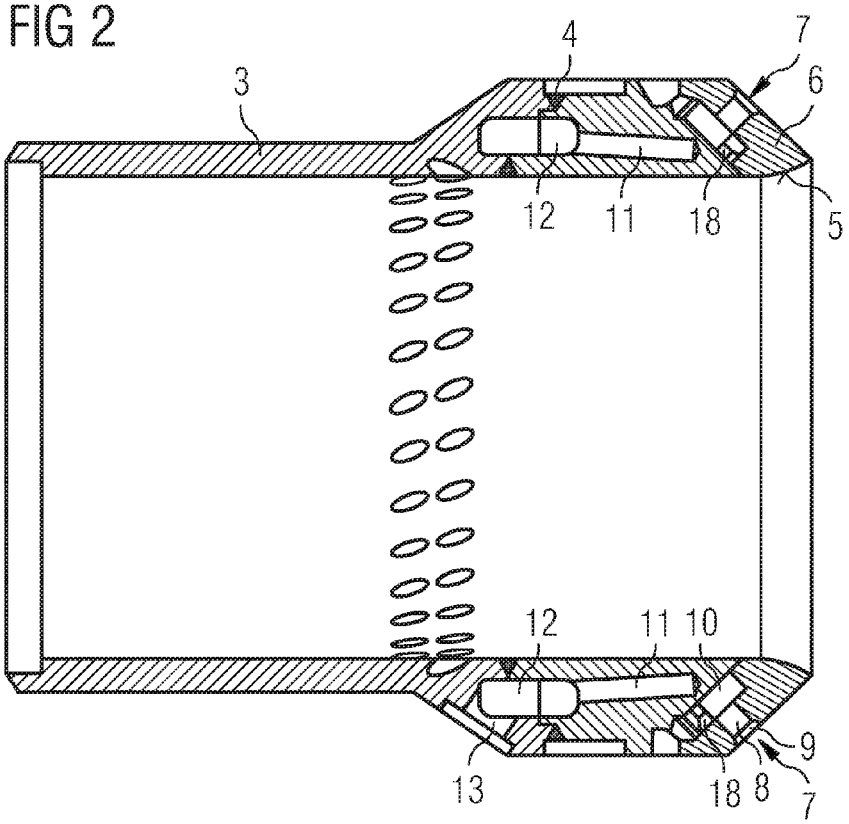
FIG. 2 shows a cross section through a burner head according to FIG. 1.
Figure 3:
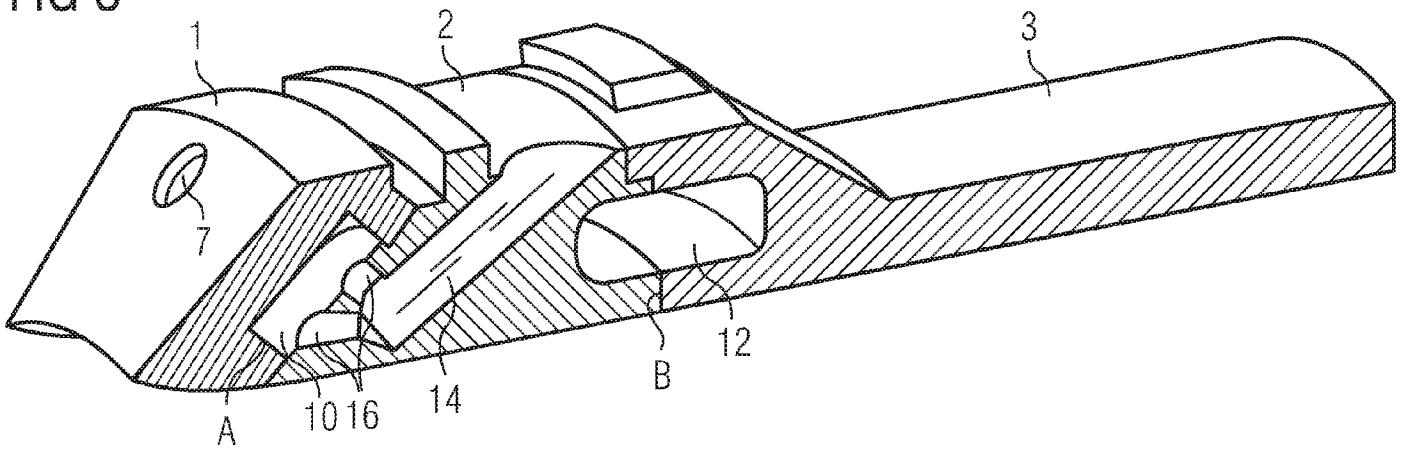
FIG. 3 shows in perspective view a 30° sector of the burner head according to FIG. 1 taken at the plane of the air channels.
Figure 4:
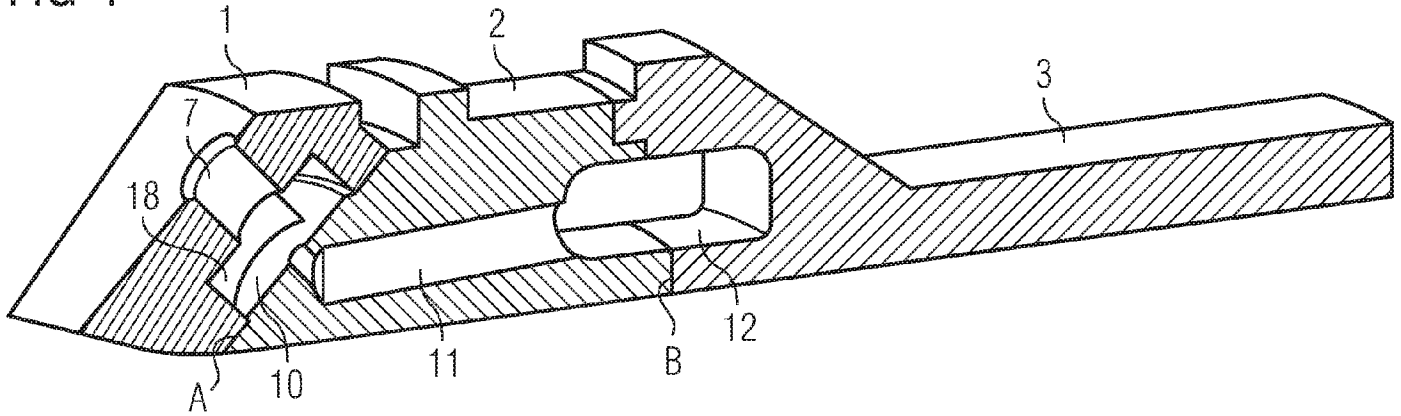
FIG. 4 shows in perspective view a 15° sector of the burner head according to FIG. 1 taken at the plane of the fuel channels.
Figure 5:
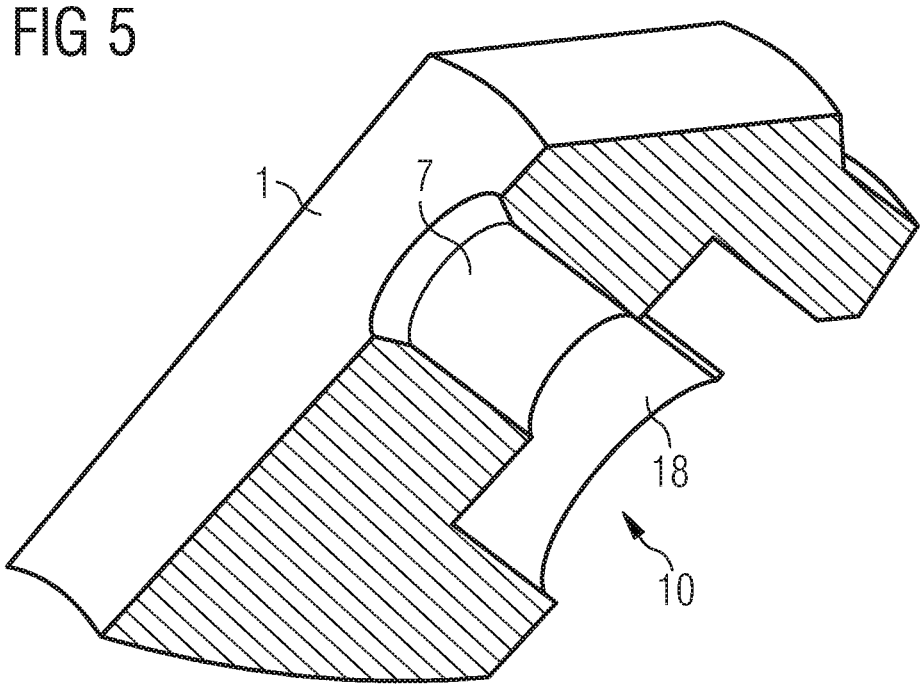
FIG. 5 shows the burner tip of the 15° sector according to FIG. 4.
Figure 6:
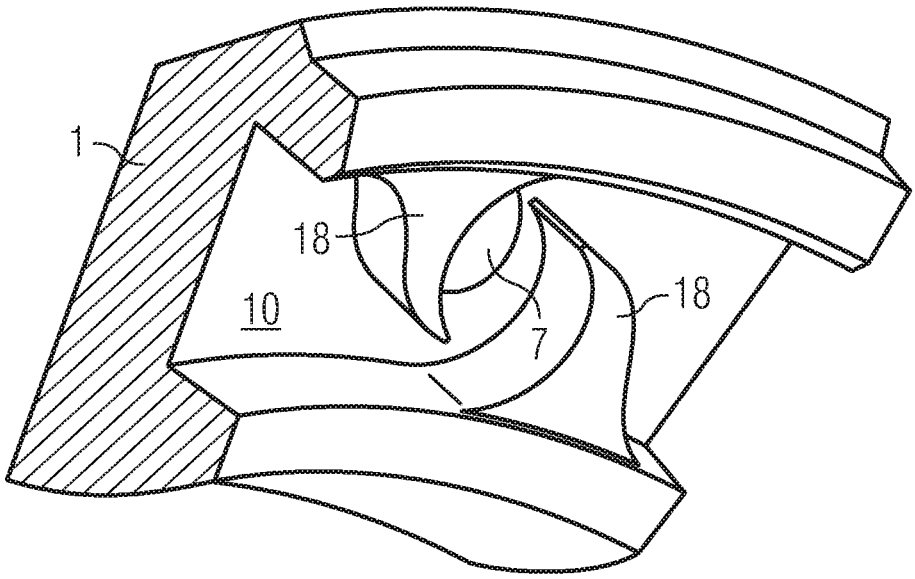
FIG. 6 shows the burner tip of the 30° sector according to FIG. 3.

The burner head according to the invention comprises three parts, namely a burner tip 1, a spacer ring 2, and a mixing tube 3. These three parts are joined across the lines A and B (FIG. 3, 4). Along these lines A and B the parts can be partly welded or brazed together. One of the weldings is shown as a welding seam 4 in FIG. 2. When assembled the back face of the burner tip 1 abuts the front face of the spacer ring 2, and the back face of the spacer ring 2 abuts the front face of the mixing tube 3.

The burner tip 1 has a rounded inner surface 5 and a conical front surface 6.

The burner is operated under lean conditions. If the load is reduced, the burner has a tendency to become unstable when the supply with fuel is reduced. To maintain stable conditions even at low load the burner is provided with a pilot burner system which will now be described in detail.

The pilot burner system comprises a number of outlet nozzles 7 provided on the conical front surface 6 of the burner tip 1. The axis of these outlet nozzles 7 is substantially perpendicular to the plane of the conical front surface 6.

The outlet nozzle 7 has the shape of a cylinder 8 and can preferably be provided with a cone 9 having a chamfered edge at the outlet side. The cross section of the outlet nozzle 7 is preferably circular or arbitrary; e.g. conical, elliptical or of any other appropriate shape. Due to the chamfered edge of the cone 9 at the outlet side the outlet nozzle 7 avoids sharp edges which may cause high stress concentration and may crack by time.

The outlet nozzles 7 communicate with an annular mixing cavity 10 provided inside the burner tip 1.

Gas channels 11 conducting a gaseous pilot fuel are arranged in longitudinal direction inside the spacer ring 2 of the burner head. The gas channels 11 emerge into the mixing cavity 10. The gas channels 11 connect the mixing cavity 10 to an annular gas manifold 12 which is arranged inside the burner head at the connection between the spacer ring 2 and mixing tube 3. A not shown pipe supplied the pilot gas through an opening 13 arranged in the spacer ring 2 of the burner head into the gas manifold 12.

Assist air for burning the pilot gas is led in through air channels 14 with air inlets 15 on the circumference of the spacer ring 2 of the burner head. The air channels 14 are designed as bores through longitudinal side wall of the spacer ring 2 of the burner head.

Each air channel 14 ends in several, preferably in two impingement holes 16. The impingement holes 16 emerge into the mixing cavity 10 by the side of the entrance of the pilot gas. The air coming out from said impingement holes 16 is deflected 90 degrees to the sides along the mixing cavity 10. The arrangement of several impingement holes 16 improve cooling of the burner tip 1.

If required an alternative pilot fuel, e.g. oil, may be used. The pilot oil is supplied through an oil pipe 17 which communicates with a separate oil channel inside the burner head. The discharge end of the oil channel emerges into the mixing cavity 10 in alignment with one of the outlet nozzles 7.

The most important part of the invention are swirler wings 18. Several, preferably two swirler wings 18 are located inside the mixing cavity 10. They are fully or almost fully covering the height of the mixing cavity 10 in the longitudinal direction and are fully integrated with the burner tip 1. Two swirler wings 18 are arranged as a pair respectively. One swirler wing 18 of each pair of swirler wings 18 is located in the outer part and one in the inner part of the mixing cavity 10 in radial direction.

The swirler wings 18 or each pair of swirler wings 18 are located in the vicinity of one of the outlet nozzles 7. Thereby the assist air following the mixing cavity 10 to the outlet nozzle 7 is forced to swirl around the flow of pilot gas coming from the gas channel 11 and generating a swirl of well defined mixed pilot gas and assist air. The swirler wings 18 and the cylinder 8 of the outlet nozzles 7 are designed in such a way as to minimize the risk of flash back, that is the upstream propagation of the flame, by controlling the fuel distribution and the velocity components in axial and tangential direction of the outlet nozzle 7. The incoming assist air flow generated by the swirler wings 18 will also force the pilot gas to stay inside the outlet nozzle 7 and not to "leak out" into the mixing cavity 10 between two pairs of swirler wings 18 near the two impingement holes 16.

The swirler wings 18 are also designed to act as effective cooling fins, due to that they are surrounded with cool air at a high velocity, that substantially improve cooling of the hot burner tip 1. A secondary effect of the swirler wings 18 is that they even out the velocity distribution in the mixing cavity 10 resulting in a more uniform cooling of the entire burner tip 1. The swirler wings 18 could be manufactured in a cost effective way by using standard milling tools.

The invention claimed is:

1. A burner with a burner head, comprising:

a mixing tube for premixing combustion air and fuel, whereby the mixing tube, comprises:

a pilot burner system disposed in a downstream part of the mixing tube, wherein the pilot burner system includes an annular mixing cavity for receiving assist air and pilot fuel via separate entrance channels, the annular mixing cavity being in communication with a plurality of outlet nozzles for pilot fuel, wherein an impingement hole is arranged at a discharge end of each of a plurality of assist air channels emerging into the annular mixing cavity, and wherein the annular mixing cavity is provided with at least two swirler wings arranged in the vicinity of and upstream of each outlet nozzle such that the at least two swirler wings force a swirling mix of assist air and pilot fuel through the outlet nozzle.

2. The burner as claimed in claim 1, wherein the plurality of swirler wings almost fully cover a height of the annular mixing cavity in relation to an axial direction of the plurality of outlet nozzles.

3. The burner as claimed in claim 2, wherein the plurality of swirler wings are arranged as pairs of swirler wings.

4. The burner as claimed in claim 3, wherein a first swirler wing of a pair of swirler wings is arranged in an outer part of the annular mixing cavity and a second swirler wing is arranged in an inner part of the annular mixing cavity as seen in a radial direction of the burner.

5. The burner as claimed in claim 1, wherein the plurality of swirler wings are fully integrated with a burner tip.

6. The burner as claimed in claim 1, wherein the burner head includes a burner tip, a spacer ring and the mixing tube assembled to form the burner head.

7. The burner as claimed in claim 6, wherein on a circumference of the spacer ring, a plurality of air inlets connected with the plurality of assist air channels are provided.

8. The burner as claimed in claim 7, wherein the impingement hole of a least one of the plurality of assist air channels opens out in an outer part of the annular mixing cavity, and wherein the impingement hole of at least another one of the plurality of assist air channels opens out in an inner part of the annular mixing cavity as seen in the radial direction of the burner.

9. The burner as claimed in claim 1, wherein each of the plurality of outlet nozzles includes a shape of a cylinder having a circular, conical, or elliptical cross section.

10. The burner as claimed in claim 1, wherein that each of the plurality of outlet nozzles is provided with a cone including a chamfered edge at an outlet side.

11. The burner as claimed in claim 1, wherein each of the plurality of outlet nozzles is in the form of an orifice extending outwardly from the annular mixing cavity through a burner tip surface, wherein the least two swirler wings are arranged in the annular mixing cavity in the vicinity of an upstream end of the orifice.

12. A gas turbine engine, comprising:

a burner with a burner head, comprising:

a mixing tube for premixing combustion air and fuel, whereby the mixing tube, comprises:

a pilot burner system disposed in a downstream part of the mixing tube, wherein the pilot burner system includes an annular mixing cavity for receiving assist air and pilot fuel via separate entrance channels, the annular mixing cavity being in communication with a plurality of outlet nozzles for pilot fuel, wherein an impingement hole is arranged at a discharge end of each of a plurality of assist air channels emerging into the annular mixing cavity, and wherein the annular mixing cavity is provided with at least two swirler wings arranged in the vicinity of and upstream of each outlet nozzle such that the at least two swirler wings force a swirling mix of assist air and pilot fuel through the outlet nozzle.

13. The gas turbine as claimed in claim 12, wherein the plurality of swirler wings almost fully cover a height of the annular mixing cavity in relation to an axial direction of the plurality of outlet nozzles.

14. The gas turbine as claimed in claim 13, wherein the plurality of swirler wings are arranged as pairs of swirler wings.

15. The gas turbine as claimed in claim 14, wherein a first swirler wing of a pair of swirler wings is arranged in an outer part of the annular mixing cavity and a second swirler wing is arranged in an inner part of the annular mixing cavity as seen in a radial direction of the burner.

16. The gas turbine as claimed in claim 12, wherein the plurality of swirler wings are fully integrated with a burner tip.

17. The gas turbine as claimed in claim 12, wherein the burner head includes a burner tip, a spacer ring and the mixing tube assembled to form the burner head.

18. The gas turbine as claimed in claim 17, wherein on a circumference of the spacer ring, a plurality of air inlets connected with the plurality of assist air channels are provided.

* * * * *